US006036433A

United States Patent [19]

Skinner

[11] Patent Number: 6,036,433

[45] **Date of Patent: *Mar. 14, 2000**

[54] METHOD OF BALANCING THRUST LOADS IN STEAM TURBINES

[75] Inventor: David Robert Skinner, Pattersonville, N.Y.

[73] Assignee: General Electric Co., Schenectady, N.Y.

[ * ] Notice: Under 35 U.S.C. 154(b), the term of this patent shall be extended for 00 days.

[21] Appl. No.: 09/106,442

[22] Filed: Jun. 29, 1998

[51] Int. Cl.[7] ..... F01D 1/00; F01D 3/00; F03B 11/04

[52] U.S. Cl. ..... 415/106; 415/104; 415/107; 415/115; 415/116; 415/117

[58] Field of Search ..... 415/104, 106, 415/107, 115, 116, 117

[56] References Cited

U.S. PATENT DOCUMENTS

| | | | |
|---|---|---|---|
| 815,155 | 3/1906 | Fullagar | 415/107 |
| 2,410,769 | 11/1946 | Baumann | 415/104 |
| 4,578,018 | 3/1986 | Pope | 415/14 |

*Primary Examiner*—Edward K. Look
*Assistant Examiner*—Rhonda Barton
*Attorney, Agent, or Firm*—Nixon & Vanderhye

[57] ABSTRACT

In a turbine construction which includes a rotor having at least one radial step formed therein, and at least one packing ring assembly mounted in a stationary turbine component and axially spanning the radial step, a thrust balancing arrangement for the rotor which includes an axial passage in the stationary component extending from a high pressure side of the stationary component and in fluid communication with an area adjacent the radial step on the rotor. A removable restrictor in the passage permits adjustment of the step thrust.

9 Claims, 1 Drawing Sheet

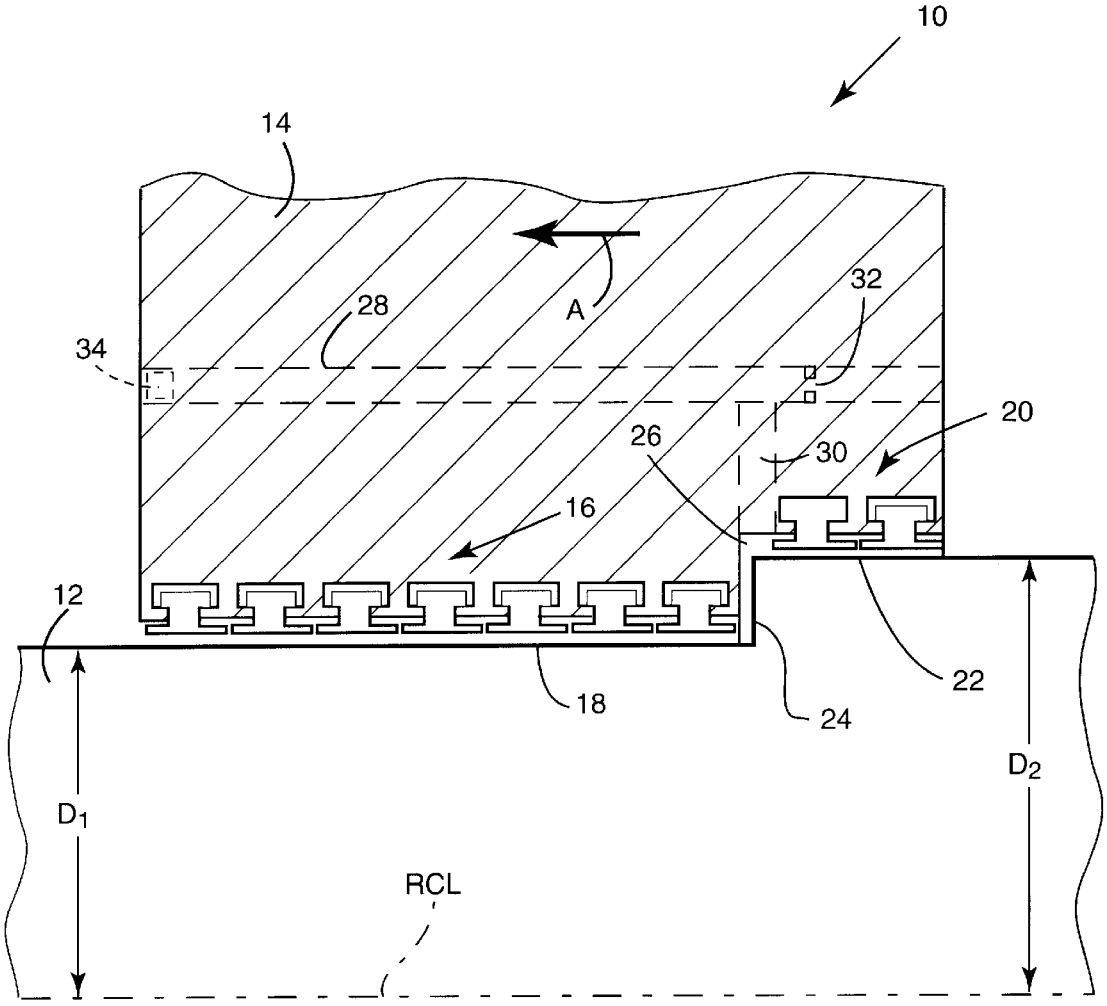
10
14
A
28
32
34
20
26
30
16
12
22
18
24
D2
D1
RCL

METHOD OF BALANCING THRUST LOADS IN STEAM TURBINES

TECHNICAL FIELD

This invention relates to steam turbines generally and, more specifically, to a method of balancing thrust forces on the rotor of a steam turbine during conversion from a "reaction" type turbine design to an "impulse" type turbine design.

BACKGROUND AND SUMMARY OF THE INVENTION

Steam turbine steampath design consists of a series of stages. Each stage consists of a rotating component and a stationary component. Energy is extracted from each of these stages. The design of a stage is commonly referred to as either "reaction" or "impulse." One of the basic differences in the two design approaches shows up in the distribution of pressure drop through the stage. In a "reaction" design, there is a nearly equal pressure drop in the buckets (the rotating turbine components) and diaphragm (stationary component) for each stage. In an "impulse" design, most of the pressure drop appears across the diaphragm only. A major consequence of this difference in pressure distribution is the development of substantial thrust on the rotor in "reaction" type designs. In a typical HP/IP opposed flow reaction configuration, the HP thrust is partly balanced by a similar but oppositely directed thrust from the IP turbine section.

For example, in converting a "reaction" HP design to an "impulse" design, an unbalance in the thrust is created since the IP turbine section thrust is still present. The magnitude of unbalanced thrust forces in the IP turbine section greatly exceeds the capacity of the thrust bearing. By selectively varying the diameters of the HP rotor in regions with different pressures, however, a compensating "step thrust" can be developed. This is a well known practice which has been used by turbine manufacturers for many years.

During conversion of specific turbine designs from the "reaction" type to the "impulse" type, oftentimes one can only take an educated guess as to the magnitude of the thrust in the IP turbine section. As a result, any deviation between the compensating step thrust and the original actual thrust can lead to severe operational problems for a hybrid "reaction/impulse" configuration. Since the compensating step thrust is determined by the geometry of the rotor, modification to adjust the step thrust would require extensive effort, including disassembly and remachining of the components, including the rotor.

This invention takes advantage of the fact that step thrust can be developed in the HP packing which isolates the HP inner and outer casing. In accordance with one exemplary embodiment of the invention, a bypass hole is drilled through the stationary component (for example, the packing casing or turbine inner shell), parallel to the rotor and spanning several packing rings. The latter may be arranged in groups with different diameters—one group sealing the rotor along a first smaller diameter portion, and a second group sealing the rotor along a larger diameter portion, as determined by a radial step in the rotor. A radial hole is drilled in the casing or inner shell, establishing fluid communication between the axial bypass hole and the adjustable pressure region at the rotor step. The bypass hole is plugged at the downstream or lower pressure side, forcing the flow through the radial hole to the step region of the rotor. The axial bypass hole contains a replaceable flow restrictor or orifice, upstream of the radial hole, sized to achieve a specific pressure at the rotor step. The combination of pressure and rotor step size are instrumental in determining the magnitude of the step thrust. It is desirable, however, to alter the pressure to achieve the desired step thrust rather than to modify the rotor—a considerably more complex and costly route. In accordance with one exemplary embodiment, during initial start-up of the turbine modified as described above, the thrust bearing temperatures are monitored at low load levels. Thrust bearing temperature can be used to determine if the deviation between the original rotor thrust and the compensating step thrust is excessive. If the thrust unbalance is excessive, the orifice can then be easily modified (for example, by replacement with a flow restrictor of different orifice size) to achieve the proper operating thrust balance. To facilitate the adjustment, it is desirable to have access to the flow restrictor from outside the outer turbine shell.

Accordingly, in a first exemplary embodiment of the invention, there is provided a turbine construction which includes a rotor having at least one radial step formed therein, and at least one packing ring assembly mounted in a stationary turbine component and axially spanning the radial step, a thrust balancing arrangement for the rotor comprising an axial passage in the stationary component extending from a high pressure side of the stationary component and in fluid communication with an area adjacent the radial step on the rotor.

In another aspect, the invention relates to a method of converting a reaction type turbine to an impulse type turbine, the impulse turbine including a rotor having at least one radial step formed therein, and at least one packing ring assembly mounted in a stationary turbine component and axially spanning the radial step; the method comprising the steps of:

a) forming an axial passage in the stationary component from a high pressure side thereof to a location adjacent the axial step;

b) placing a replaceable flow restrictor in the axial passage; and c) supplying high pressure medium to the area adjacent the radial step to thereby create a thrust force on the rotor in a direction opposite to an unbalancing thrust load on the rotor.

Other objects and advantages of the subject invention will become apparent from the detailed description which follows.

BRIEF DESCRIPTION OF THE DRAWING

The FIGURE shows a partial side elevation, partly in section, showing a stationary turbine component and associated rotor, with adjustable air flow access to an adjustable pressure region at a radial step in the turbine rotor.

BEST MODE FOR CARRYING OUT THE INVENTION

The single FIGURE shows a portion 10 of a steam turbine including a rotor 12 and a stationary portion 14 which may be part of the turbine inner shell, or a separate packing casing. A first group of packing ring seals 16 (which may be of the conventional labyrinth type) is shown located between the stationary portion 14 and the rotor 12 along a first smaller diameter portion 18 (diameter $D_1$) of the rotor as determined by the rotor centerline RCL. A second group of seals 20 is shown along a stepped, larger diameter portion 22

(diameter $D_2$) of the rotor, the two rotor portions connected by a radial step 24 formed in the rotor. An adjustable pressure region 26 is thus established in the vicinity of step 24. In order to access the region 26, an axial bore 28 is drilled through the stationary turbine component 14 radially outwardly of the groups of seals 16, 20. A radial passage 30 extends between the bore 28 and the pressure region 26. The number of axial bores 28 and radial passages 30 provided about the 360° circumference of the rotor may be varied as necessary.

In accordance with this invention, a replaceable flow restrictor 32 is located within the bore 28, just upstream of the radial passage 30. A plug 34 closes the downstream end of the bore 28, so that fluid passing through the restrictor orifice in a right to left direction indicated by arrow A (from the high pressure side of the seal) is forced to flow through the radial passage 30 to the region 26, thereby increasing the compensating thrust on the rotor in a left to right direction as viewed in the Figure. Typically, the initial orifice size determination is done based on calculations, but once the turbine is operating, further adjustments are made by replacing the flow restrictor with another having a different orifice size. By so adjusting the orifice, one can adjust the flow of steam into the pressure region 26 and thus balance the thrust on the step or face 24 of the rotor 12. The restrictor 32 may be fixed in the bore 28 by threading or by other suitable means, or may be part of a removable sleeve, but in any event, it is advantageous to have the restrictor easily installed and removed since restriction replacement of the device is the most efficient way to alter the step thrust.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a turbine construction which includes a rotor having at least one radial step formed therein, and at least one packing ring assembly mounted in a stationary turbine component and axially spanning the radial step, a thrust balancing arrangement for the rotor comprising an axial passage in the stationary component extending from a high pressure side of the stationary component and in fluid communication with an area adjacent the radial step on the rotor, and wherein a flow restrictor is located in said axial passage.

2. The turbine construction of claim 1 wherein said axial passage communicates with said area via a passage extending radially between said area and said axial passage.

3. The turbine construction of claim 2 wherein a flow restrictor is located in said axial passage between said radial passage and said high pressure side.

4. The turbine construction of claim 3 wherein said flow restrictor is provided as a removable insert in said axial passage.

5. The turbine construction of claim 1 wherein a plurality of said axial passages are circumferentially spaced about said stationary component.

6. In a turbine construction which includes a rotor having at least one radial step formed therein, and at least one packing ring assembly mounted in a stationary turbine component and axially spanning the radial step, a thrust balancing arrangement for the rotor comprising an axial passage in the stationary component extending from a high pressure side of the stationary component and in fluid communication with an area adjacent the radial step on the rotor, and wherein said axial passage is closed at an end remote from said high pressure side by a removable plug.

7. In a method of converting a reaction type turbine to an impulse type turbine, the impulse turbine including a rotor having at least one radial step formed therein, and at least one packing ring assembly mounted in a stationary turbine component and axially spanning the radial step; the method comprising the steps of:

a) forming an axial passage in the stationary component from a high pressure side thereof to a location adjacent the axial step;

b) placing a replaceable flow restrictor in the axial passage; and c) supplying high pressure medium through the flow restriction to the area adjacent the radial step to thereby create a thrust force on the rotor in a direction opposite to an unbalancing thrust load on the rotor.

8. The method of claim 7 wherein step a) includes forming more than one axial passage in the stationary component.

9. The method of claim 7 wherein step b) includes placement of a removable flow restrictor in said axial passage.

* * * * *